United States Patent [19]

Matsushita et al.

[11] Patent Number: 4,486,764

[45] Date of Patent: Dec. 4, 1984

[54] PLAIN PAPER TRANSFER TYPE PRESSURE-SENSITIVE COPYING PAPER

[75] Inventors: Toshihiko Matsushita, Funabashi; Sadao Morishita, Ibaraki; Shigetoshi Hiraishi, Tokyo, all of Japan

[73] Assignee: Mitsubishi Paper Mills, Ltd., Tokyo, Japan

[21] Appl. No.: 554,173

[22] Filed: Nov. 22, 1983

Related U.S. Application Data

[63] Continuation of Ser. No. 287,121, Jul. 27, 1981, abandoned.

[30] Foreign Application Priority Data

| | | | |
|---|---|---|---|
| Aug. 1, 1980 | [JP] | Japan | 55/106051 |
| Nov. 22, 1980 | [JP] | Japan | 55/165062 |
| Nov. 22, 1980 | [JP] | Japan | 55/165064 |

[51] Int. Cl.[3] ..... B41M 5/16

[52] U.S. Cl. ..... 346/209; 346/205; 346/214

[58] Field of Search ..... 282/27.5; 427/150, 151; 428/320.4–320.8, 411, 488, 537, 914

[56] References Cited

U.S. PATENT DOCUMENTS

| | | | |
|---|---|---|---|
| 3,554,781 | 1/1971 | Matsukawa | 428/320.8 |
| 4,139,218 | 2/1979 | Davis et al. | 282/27.5 |
| 4,199,618 | 4/1980 | Golden | 427/145 |
| 4,299,411 | 11/1981 | Brockett | 428/320.8 |
| 4,347,283 | 8/1982 | Hiraishi et al. | 427/151 |
| 4,387,913 | 6/1983 | Torii et al. | 282/27.5 |
| 4,411,451 | 10/1983 | Matsushita et al. | 282/27.5 |
| 4,435,471 | 3/1984 | Matsushita et al. | 428/320.8 |

*Primary Examiner*—Bruce H. Hess

*Attorney, Agent, or Firm*—Cushman, Darby & Cushman

[57] ABSTRACT

A plain paper transfer type pressure-sensitive copying paper comprising a coated paper obtained by adding a surfactant to a coating color comprising a color-forming agent, a color-developing agent capable of reacting with said color-forming agent to yield a colored product and a wax; and coating the color to the surface of a support is free from the self color-formation of coated surface at the time of typing under pressure and is excellent in transferability and color-formability.

1 Claim, No Drawings

PLAIN PAPER TRANSFER TYPE PRESSURE-SENSITIVE COPYING PAPER

This is a continuation of application Ser. No. 287,121, filed July 27, 1981, now abandoned.

BACKGROUND OF THE INVENTION

This invention relates to a colorless pressuresensitive copying paper of plain paper transfer type with which a copy or a record can be made on a plain paper.

Hitherto known pressure-sensitive copying papers are products in which an over sheet and an under sheet are superposed so that their coated surfaces confront each other, said over sheet being obtained by dissolving a colorless electron-donating color-forming agent into a nonvolatile oil or the like, preparing a microcapsule by using this "color-forming agent"-containing oil as a core material and coating the microcapsule onto the back side of a support, and said under sheet being obtained by coating a colorless electron-accepting color-developing agent onto the front surface of a support. If it is pressed and typed by means of a typewriter or the like, a colored image can be formed on the under sheet. When three or more copies are to be produced, a necessary number of intermediate sheets obtained by coating a color-developing agent and a microcapsule containing a color-forming agent respectively onto the front and back sides of a support are inserted between the over sheet and the under sheet, whereby many sheets of copy can be obtained. Further, there is also the so-called self-contained pressure-sensitive copying paper in which a "color-forming agent"-containing microcapsule and a color-developing agent are coated onto the same surface of a support. They are in extensive use in business paper and the like, because no colored substance is used in them and therefore they do not stain clothes. However, they have a fault that at least two kinds and usually three kinds of coated papers, i.e. over sheet, intermediate sheet and under sheet, must be prepared and the copied image can be obtained only on the intermediate sheet, under sheet or the support of the self-contained pressure-sensitive copying paper which is coated with a color-developing agent.

Further, it is already known that, in the abovementioned self-contained pressure-sensitive copying paper, a colored image is obtainable only on the coated surface and no transfer image is obtained at all on plain paper if the coated surface and a plain paper are superposed and typed.

As used herein, the term "plain paper" means a support on the transfer surface of which neither electron-donating color-forming agent nor electron-accepting color-developing agent exists.

As a pressure-sensitive copying paper having a color-forming agent and a color-developing agent on the same surface of a support and being capable of forming a copied image on plain paper, those disclosed in Japanese Patent Kokai (Laid-Open) No. 126,111/79, Japanese Patent Kokoku (Post-Examination Publication) No. 16,728/78 and Japanese Patent Kokai (Laid-Open) No. 159,008/79 can be referred to.

In Japanese Patent Kokai (Laid-Open) No. 126,111/79, it is mentioned to coat, on a support, a coating color obtainable by adding a solid color-forming agent and a color-developing agent into a wax, so as to give a monolayer. It is also clearly mentioned there that said coating color shows a color-forming reaction and is colored just after the color-forming agent and the colordeveloping agent are mixed together. That is, said invention relates to a pressure-sensitive transfer material having a coating layer which is colored similarly to back-carbon paper. It is disadvantageous in appearance because the coating layer is colored. Japanese Patent Kokoku (Post-Examination Publication) No. 16,728/78 relates to chelate color formation. Said invention consists in coating an encapsulated reactant onto a support and additionally coating thereon a co-reactant dissolved in a solvent. Because of the use of solvent the microcapsule wall material is limited to materials resistant to solvent, and there are many disadvantages in the environmental and economic phases.

In Japanese Patent Kokai (Laid-Open) No. 159,008/79, the use of waxes is mentioned. Said invention consists in the so-called two-layer coating in which a microcapsule of "color-forming agent"-containing oil is coated onto a support together with a binder and thereafter a layer comprising a wax and a color-developing agent is coated thereon. In said invention, it is necessary to coat the microcapsule layer on the whole surface with an air knife coater or the like and thereafter to coat the color-developing agent, so that the production involves one additional process which increases the cost. Further, the microcapsule layer is prepared by coating microcapsules onto a support together with a binder in the same manner as in the over sheet of commercial pressure-sensitive copying papers, so that transfer of said layer to plain paper scarcely occurs and the "color-forming agent"-containing oil which has been liberated upon the fracture of capsule occurring at the time of typewriting partially migrates into the support. Thus, the amount of color-forming agent participating in color formation is limited, which is disadvantageous in the phases of transferability and color-formability.

On the other hand, the present inventors have already applied for a patent on a related plain paper transfer type pressure-sensitive copying paper, in Japanese Pat. Application No. 26,390/80 filed on Mar. 3, 1980. Although in this plain paper transfer type pressure-sensitive copying paper a clear image can be formed when a plain paper is superposed thereunder and they are typed with a pressure, a dissymmetrical image is formed on the coated surface of the plain paper transfer type pressure-sensitive copying paper itself or on the surface coming into a direct contact with the plain paper. If this dissymmetrical image remains as it is, it may be usable for the purpose of preventing alternations. However, it is still desirable that color formation does not occur on the coated surface. Said plain paper transfer type pressure-sensitive copying paper has a fault that the color formation of coated surface cannot be prevented perfectly.

SUMMARY OF THE INVENTION

The present inventors conducted earnest studies with the aim of overcoming the above-mentioned fault. As the result, it was found that a colorless, plain paper transfer type pressure-sensitive copying paper excellent in transferability and color-formability with which the self color-formation of coated surface occurring at the time of typing under pressure can be prevented and a transfer image can be formed on plain paper, can be obtained by mixing a surfactant into a coating color for coating the same surface of a support, said coating color comprising a colorless electron-donating color-forming agent, a colorless electron-accepting color-developing agent capable of reacting with said color-forming agent to yield a colored product, and a wax.

As another effect of this invention, it can be referred to that, owing to the mixing of surfactant, the dispersing effect of coating color can be increased and the suitability of coating color can be improved.

As yet another effect of this invention, it can be referred to that, owing to the mixing of surfactant, the coated surface can be made less sensitive to staining before the application of pressure and thereby the coated surface can be kept colorless.

DETAILED DESCRIPTION OF THE INVENTION

Both or either of the color-forming agent and the color-developing agent used in this invention are (is) micro-encapsulated. That is, at least one of them is unexceptionally in the form of microcapsule, in which the color-forming agent or color-developing agent is contained in the form of being dissolved in a solvent. The color-forming agent and the color-developing agent take part in color-forming reaction by the medium of said solvent.

When a plain paper transfer type pressure-sensitive copying paper with its coated surface facing downward is superposed on a plain paper and a pressure is applied thereon, a transfer image is obtained generally on the plain paper. However it is usual that a self color-formation simultaneously occurs on the coated surface due to imperfect transfer and the typed dissymmetrical image is formed there. After many studies, the inventors succeeded in completely eliminating this self color-formation by mixing a surfactant having a desensitizing effect. The transfer image thus obtained is quite clear and has a high color intensity. The coated surface keeps colorless like before being typed, and a background having no coloration can be obtained. Since the surfactant naturally has a dispersant effect, its addition to the coating color makes the mixing of colorforming agent, color-developing agent and wax uniform and stable and facilitates the coating process. Further, in some cases, there may exist in the coating color a very small quantity of imperfect microcapsules or a solvent containing free color-forming or color-developing agent which can color the paper surface after coating or there may occur coloration due to the rupture of microcapsule occurring at the time of handling the coated paper. However, this invention is characterized in that, owing to the action of surfactant, the coated surface can be desensitized to staining occurring from these causes and its background can be always kept colorless.

The surfactants usable in this invention include anionic, cationic, nonionic and ampholytic surfactants, which are all effective in this invention. Examples of said anionic surfactants include fatty acid salts, alkyl sulfuric ester salts, alkylbenzenesulfonic acid salts, alkylnaphthalenesulfonic acid salts, alkylsulfosuccinic acid salts, alkylphosphoric ester salts, polyoxyethylene sulfuric ester salts, naphthalenesulfonic acid-formaldehyde condensate and the like. Examples of said cationic surfactants include alkylamine salts, quaternary ammonium salts and the like. Examples of said nonionic surfactant include polyoxyethylene alkyl ether, polyoxyethylene alkylphenol ether, sorbitan fatty acid esters, polyoxyethylene sorbitan fatty acid esters, polyoxyethylene sorbitol fatty acid esters, polyoxyethylene-alkylamine, polyoxyethylene fatty acid esters, glycerin fatty acid esters, oxyethylene-oxypropylene and the like.

Example of said ampholytic surfactants include alkylbetaine.

Next, in this invention, the surfactant is preferably used in an amount of 3–15% by weight based on the solid content of the coating color comprising color-forming agent, color-developing agent and wax into which the surfactant is mixed. More preferably, the amount of the surfactant is 5–12% by weight. If it is less than 3% by weight, the self color-formation of the coated surface cannot be eliminated perfectly when it is superposed on a plain paper and typed under pressure, or the effect of the surfactant does not appear. If the amount is larger than 15% by weight, its desensitizing action is undesirably exercised also on the transfer image when it is typed like above, though self colorformation can be eliminated perfectly. As above, an amount of 3–15% by weight is most effective in that the self color-formation of coated surface is eliminated and desensitization of transfer image does not occur.

When many sheets of copy are to be obtained, it is also possible to use the coated paper constituting the plain paper transfer type pressure-sensitive copying paper of this invention as the so-called intermediate sheet for the hitherto known pressure-sensitive copying paper. For example, when two sheets of the coated paper constituting the plain paper transfer type pressure-sensitive copying paper of this invention are superposed so that their coated surfaces face downward, one sheet of plain paper is superposed thereunder and three copies are taken, a colored typed image is formed on the surface of the intermediate support (the second sheet). Longterm stability, particularly wet and thermostability was studied on this coated paper corresponding to the so-called intermediate sheet and on the third sheet of plain paper on which typed image had been formed, and there was revealed that, as compared with the plain paper on which typed image has been formed, the second coated paper had a fault that the surfactant in the coating layer exhibited migration, reached the colored image on the opposite side of the support and thereby desensitized the image.

This fault could be overcome by additionally adding a water-soluble polymer and/or latex to a coating color comprising a colorless electron-denoting colorforming agent, a colorless electron-accepting colordeveloping agent capable of reacting with said colorforming agent to form a colored product, a wax and a surfactant, and coating the resulting color to the surface of support.

The plain paper transfer type pressure-sensitive copying paper by the use of water-soluble polymer and/or latex is small in the migration effect of surfactant and stable in typed image. The migration of surfactant is a phenomenon that surfactant freely moves around in the coating layer by the absorbed moisture and temperature, which results in a desensitization in the intensity of typed image. That is, the surfactant migrates from inside of coating layer to the surface of paper, passes inside of the paper and reaches the image. For preventing this migration from the surface of paper to its inside, it is most effective to directly cover and shield the paper surface with a definite film.

Although the wax present in the coating layer has an effect of combining the color-forming agent and the color-developing agent and binding them to the surface of paper, its effect cannot be exercised sufficiently upon the surfactant moving around on the paper surface. If a water-soluble polymer and/or latex is mixed into coating layer, it combined the color-forming agent and the color-developing agent present in coating layer with the wax and, at the same time, it enables to cover the paper surface owing to its film-forming effect. If a substance excellent in film-formability such as water-soluble polymer and/or latex is mixed into the coating layer, it rapidly forms a film in the course of coating and drying to give a uniform surface free from interstices between the coated surface and the paper surface. A substance having a higher film-formability exhibits a greater effect of fixing the surfactant in the coating layer and suppressing the migration of surfactant due to absorbed moisture and temperature. Among water-soluble polymers, even naturally occurring ones can form a film considerably stable to absorbed moisture and temperature if it is once dried, so that they can fulfil the object of stabilization to absorbed moisture and temperature. Further, synthetic latices and synthetic water-soluble polymers are water-insoluble in themselves, so that they are enough for the purpose of stabilization.

However, it should be taken into consideration that some of the readily available latices contain a large quantity of emulsifier (surfactant) for the purpose of stabilizing the emulsion. In such a case, there can appear an effect not due to the latex itself but due to the too large an amount of the emulsifier (surfactant) present in the system, so that it is necessary to change the amount of surfactant used in the formulation of coating color appropriately. It is enough to calculate the amount of surfactant based on the total formulation of the coating color. As said water-soluble polymer and/or latex, various substances can be used. As the naturally occurring water-soluble polymer, at least one kind selected from, for example, oxidized starch, casein, gum arabi, gelatin and dextrin is used. As the synthetic water-soluble polymer and/or latex, at least one kind selected from, for example, hydroxyethyl cellulose, vinyl acetate, vinyl acetate-acrylic acid copolymer, ethylene-vinyl acetate copolymer, polyacrylonitrile, acrylonitrile-butadiene copolymer, acrylonitrile-styrene copolymer, styrene-butadiene copolymer, polyacrylamide, polymethyl methacrylate, polyvinyl alcohol, vinylidene chloride copolymer, carboxymethyl cellulose and styrenemaleic acid copolymer is used.

If styrene-butadiene copolymer is used as said water-soluble polymer and/or latex, a pressuresensitive copying paper particularly excellent in wet and thermostability is obtained.

The amount of said water-soluble polymer and/or latex of this invention is in the range of 5–30% by weight based on the solid content in the coating color, from the viewpoint of stability of image and maintaining the adhesion of coating layer. More preferably, it is 10–25% by weight. If it is less than 5% by weight, the effect of stabilizing image disappears. If it is larger than 30% by weight, color intensity of the formed image is undesirably low.

As the color-forming agent used in this invention, colorless or light-colored electron-donating organic compounds can be used. Examples of said compounds include the followings: triarylmethane compounds such as 3,3-bis(p-dimethylaminophenyl)-6-dimethylaminophthalide, 3,3-bis(p-dimethylaminophenyl)-phthalide, 3-(p-dimethylaminophenyl)-3-(1,2-dimethylindol-3-yl)-phthalide, 3-(p-dimethylaminophenyl)-3-(2-methylindol-3-yl)-phthalide, 3-(p-dimethylaminophenyl)-3-(2-phenylindol-3-yl)-phthalide, 3,3-bis(9-ethylcarbazol-3-yl)-5-dimethylaminophthalide and the like; dimethylmethane compounds such as 4,4'-bis-dimethylaminobenzhydrin benzyl ether, N-halophenylleucoauramine, N-2,4,5-trichlorophenyl-leucoauramine and the like, xanthene compounds such as rhodamine B-anilinolactam, 3-dimethylamino-7-methoxyfluoran, 3-diethylamino-7-chlorofluoran, 3-diethylamino-6,8-dimethylfluoran, 3-diethylamino-7-methylaminofluoran, 3,7-diethylaminofluoran, 3-diethylamino-7-dibenzylaminofluoran, 3-diethylamino-chloroethylmethylaminofluoran, and the like; thiazine compounds such as benzoyl leucomethylene blue, p-nitrobenzyl-leucomethylene blue and the like; spiro compounds such as 3-methyl-spirodinaphthopyran, 3-ethyl-spirodinaphthopyran, 3,3'-dichloro-spirodinaphthopyran, 3-propyl-spirodibenzopyran and the like; and so on. They may be used either alone or in combination.

As color-developing agent, there are known inorganic acidic substances such as acid clay, activated clay, kaolinite, zeolite, bentonite, attapulgite and the like; phenolic color-developing agents such as substituted phenols, phenol-formaldehyde condensate, alkyl-substituted phenol-formaldehyde condensates, aryl-substituted phenol-formaldehyde condensates and the like and their metallic salts; benzoic acid, chlorobenzoic acid, toluic acid and their metallic salts; salicyclic acid type colordeveloping agents such as salicyclic acid, 5-tertbutylsalicyclic acid, 3,5-di-tert-butylsalicyclic acid, 3,5-di($\alpha$-methylbenzyl)-salicylic acid and the like and their metallic salts; and the like. They may be used either alone or in combination. When the color-developing agent is used after micro-encapsulation, oil-soluble color-developing agents such as phenol type, salicylic acid type and the like are preferable.

These color-forming agents and/or color-developing agents are formed into microcapsule by the process well known in the art. The process includes monomer polymerization process, phase separation process, spray drying process and the like. As the material for forming wall, gelatin, casein, gum arabi, rosin, starch, collagen, sodium alginate, ethyl cellulose, carboxymethyl cellulose, benzyl cellulose, polyvinyl alcohol, polyethylene, polyamide, polyester, polyurethane, polyacrylamide, polyethyleneimine and the like can be used, though they are not particularly limitative.

As the nonvolatile oil used for the microencapsulation, alkylnaphthalene type, chlorinated paraffin type, diarylethane type, alkyldiphenyl type, aromatic ester type and aliphatic ester type of oils and the like can be referred to. They are used either alone or in combination.

As said wax, there can be used animal waxes such as beeswax, spermaceti, Chinese wax, lanolin and the like; vegetable waxes such as candelilla wax, carnauba wax and the like; mineral waxes such as montan wax, ozokerite, ceresin, lignite wax and the like; petroleum waxes such as paraffin wax, micro-crystalline wax and the like; modified waxes such as montan wax derivatives, paraffin wax derivatives, micro-crystalline wax derivatives and the like; hydrogenated waxes such as caster wax, opal wax and the like; synthetic waxes such as low molecular weight polyethylene and its derivatives, acra wax, distearyl ketone and the like; and amide type waxes including saturated fatty acid amides such as caproic amide, caprylic amide, pelargonic amide, capric amide, lauric amide, tridecanoic amide, myristic amide, stearic amide, behenic amide, ethylene-bis-stearic amide and the like and unsaturated fatty acid amides such as caproleic amide, myristoleic amide, oleic amide, elaidic amide, linoleic amide, erucic amide, ricinoleic amide, linolenic amide and the like. They may be used either alone or in combination.

As the process for producing the plain paper transfer type pressure-sensitive copying paper of this invention, a process which comprises coating an aqueous dispersion type coating color onto the whole or partial surface of a support by means of general coater such as air knife coater or the like or a printing machine such as flexographic printing machine or the like, a process which comprises spray-drying a microcapsule, and then if necessary, uniformly mixing it together with finely powdered color-forming agent or color-developing agent at the melting point of wax to give a coating color, and printing it onto a part of a support by means of usual carbon printing machine or the like, or some other process may be selected arbitrarily.

At the time of preparing the coating color of this invention, a color property improving agent may be added depending on the coater or printing machine. For example, a thickening agent for making the viscosity constant, a surfactant for improving the dispersibility, and the like can be referred to, though the color property improving agent is not limited to them, of course.

As the support on which the coating layer of this invention is to be formed, paper is used mainly, although various unwoven cloths, plastic films, synthetic papers, metallic foils and the like or composite sheets comprising a combination thereof can also be used.

Hereunder, this invention will be explained concretely with reference to examples, wherein parts are by weight.

EXAMPLE 1

(1) A microcapsule dispersion containing a color-forming agent was prepared in the following manner.

80 Parts of a solution of 4.8 parts of 3,3-bis(p-dimethylaminophenyl)-6-dimethylaminophthalide (CVL) in 1,1-diphenylethane was emulsified into 100 parts of 5% aqueous solution of styrene-maleic acid copolymer containing a small quantity of sodium hydroxide and having a pH value of 4.0. On the other hand, 10 parts of melamine, 25 parts of 37% aqueous solution of formaldehyde and 65 parts of water were mixed together. The mixture was adjusted to pH 9 with sodium hydroxide and heated to 60° C., whereby the mixture became transparent in 15 minutes to give a melamine-formaldehyde precondensate. It was added to the above-mentioned emulsion and stirring was continued at a liquid temperature of 60° C. In 30 minutes, formation of capsule was observed, so that the mixture was cooled to room temperature. The microcapsule dispersion thus obtained had a solid content of about 45%.

(2) A microcapsule dispersion containing a color-developing agent was prepared in the following manner.

A color-developing agent capsule containing p-phenylphenol resin was produced by repeating the abovementioned procedure of (1), except that the 4.8 parts of CVL was replaced by 32 parts of p-phenylphenol resin. The microcapsule dispersion thus obtained had a solid content of about 45%.

(3) By using the microcapsule dispersions prepared in (1) and (2), a coating color containing a 45% paraffin wax dispersion and a primary straight chain alcohol ethoxylate (nonionic surfactant, commercial name Adekatol LO-15, manufactured by Asahi Denka Kogyo) as additionally mixed ingredients was prepared according to the formulation mentioned below. It was coated to a paper having a basis weight of 48 g/m$^2$ so as to give a coating weight of 8 g/m$^2$, by means of a meyer bar.

| | |
|---|---|
| 45% dispersion of color-forming agent capsule | 10 parts |
| 45% dispersion of color-developing agent capsule | 50 parts |
| 45% emulsion of paraffin wax | 15 parts |
| Nonionic surfactant | 3 parts |
| Water | 130 parts |

The coated paper having a colorless coating layer, herein obtained, was superposed on a plain paper so that the coating layer faced downward, and letters were typed thereon with a typewriter. Thus, a clear blue-colored transfer image was obtained on the plain paper. On the other hand, the self color formation of the coated surface did not occur at all, and the background of coating layer kept colorless unchangeably.

EXAMPLES 2–7

The nonionic surfactant Adekatol LO-15 used in Example 1 was replaced with the following surfactants.

| Example | Kind of surfactant | Composition | Commercial name | Mixing ratio of surfactant in coating color (%) |
|---|---|---|---|---|
| 2 | Nonionic surfactant | Polyoxyethylene oleyl ether | Emulgen 420 | 6 |
| 3 | Nonionic surfactant | Polyoxyethylene sorbitan trioleate | Tween 85 | 5 |
| 4 | Anionic surfactant | Potassium soap of oleic acid | OS soap | 10 |
| 5 | Anionic surfactant | Dialkyl sulfosuccinate | Perex OT-P | 10 |
| 6 | Cationic surfactant | Laurylamine acetate | Acetamine 24 | 10 |
| 7 | Ampholytic surfactant | Stearyl-betaine | Anhitol 86B | 12 |

The coated papers of Examples 2–7 were superposed on plain so that the coating color faced downward, and letters were typed thereon with a typewriter. Thus, a clear blue-colored transfer image was formed on the plain paper without any self color formation of the coated surface at all.

COMPARATIVE EXAMPLE 1

A coated paper was prepared by coating a paper only with the color-forming agent microcapsule, color-developing agent microcapsule and paraffin wax of Example 1 without using the nonionic surfactant Adekatol LO-15 of Example 1. Letters were typed thereon under pressure similarly.

The result obtained was unsatisfactory in that the self color-formation of the coated paper occurred with a high intensity.

EXAMPLE 8

(1) As color-forming agent microcapsule, the same one as in Example 1 was used.

(2) As color-developing agent, 45% dispersion of p-phenylphenol resin in water was used.

(3) A coating color was prepared by mixing (1), (2), 30% aqueous dispersion of candelilla wax and nonionic surfactant polyoxyethylene-polyoxypropylene cetyl ether (commercial name NIKKOL-PBC-33, manufactured by Nikko Chemicals K.K.) according to the folloiwng formulation, and it was coated on a paper having a basis weight of 38 g/m$^2$ so as to give a coating weight of 7 g/m$^2$, by means of a meyer bar.

| | |
|---|---|
| 45% dispersion of color-forming agent capsule | 10 parts |
| 45% dispersion of p-phenylphenol resin | 20 parts |
| 30% dispersion of candelilla wax | 25 parts |
| Nonionic surfactant | 1.6 parts |
| Water | 60 parts |

The coated paper having a colorless coating layer, herein obtained, was superposed on a plain paper so that the coating layer faced downward, and letters were typed thereon with a typewriter. Thus, a clear blue-colored transfer image having a high color intensity was obtained on the plain paper.

On the other hand, the self color-formation of the coated surface did not occur at all and the background of coating layer kept colorless unchangedly.

EXAMPLE 9

By using the microcapsules of color-forming agent and color-developing agent prepared in Example 1, a flexographic printing ink was prepared according to the following formulation:

| | |
|---|---|
| Color-forming agent microcapsule | 25 parts |
| Color-developing agent microcapsule | 75 parts |
| 45% emulsion of paraffin wax | 20 parts |
| Nonionic surfactant | 4.4 parts |
| 20% aqueous solution of polyvinyl alcohol | 27.5 parts |
| Methanol | 20 parts |

The nonionic surfactant herein used was polyoxypropylene condensate (commercial name Pluronic F-88, manufactured by Asahi Denka Kogyo K.K.). The ink prepared was adjusted to a viscosity of 30 seconds as measured with Zahn cup #3, by adding water thereto. The ink thus obtained was coated on a paper by means of flexographic printing ink, so as to give a coating weight of 5 g/m$^2$. The coated paper having a colorless coating layer, thus obtained, was superposed on a plain paper, and letters were typed thereon by means of a typewriter. Thus, a clear blue-colored transfer image was obtained on the plain paper without any self color-formation of coated surface at all.

EXAMPLE 10

By using the microcapsule dispersions prepared in (1) and (2) of Example 1, a coating color containing 45% dispersion of paraffin wax, a nonionic surfactant: primary straight chain alcohol ethoxylate (commercial name Adekatol LO-15, manufactured by Asahi Denka Kogyo K.K.) and a styrene-butadiene type latex (commercial name Nipol LX 204, manufactured by Nippon Geon) as additionally mixed ingredients was prepared according to the following formulation. It was coated on a paper having a basis weight of 48 g/m$^2$ so as to give a coating weight of 9 g/m$^2$, by means of a meyer bar.

| | |
|---|---|
| 45% dispersion of color-forming agent capsule | 10 parts |
| 45% dispersion of color-developing agent capsule | 50 parts |
| 45% emulsion of paraffin wax | 15 parts |
| Nonionic surfactant | 3 parts |
| 40% styrene-butadiene latex | 23 parts |
| Water | 150 parts |

Two sheets of the coated paper having a colorless coating layer, herein obtained, were superposed together with plain papers so that each of the coating layers faced downward and confronted a plain paper, and letters were typed thereon by means of a typewriter. Thus, clear blue-colored transfer images were obtained on one side, opposite to the coated surface, of the second sheet and on the plain paper. On the other hand, the self color-formation of coated surface did not occur at all and the background of coating layer kept colorless unchangedly.

After typing, the second and third sheets were kept at a humidity of 90% and a temperature of 45° C. for a whole day and night for the sake of wet and thermal stability test. Its color intensity was compared with that of untested sample, and the degree of drop in wet and thermal stability (%) was calculated according to the following equation. Thus, it was found that the degree of drop in the copied second and third sheet was 3% and 1%, respectively.

$$\text{Degree of drop (\%)} = \frac{\left(\text{Color intensity on untested sample}\right) - \left(\text{Color intensity on tested sample}\right)}{\text{Color intensity on untested sample}} \times 100$$

EXAMPLES 11-32 AND COMPARATIVE EXAMPLES 2-14

Plain paper transfer type pressure-sensitive copying papers were produced by repeating the procedure of Example 10, except that the kind and amount of water-soluble polymer and/or latex were as shown in Table 1.

TABLE 1

| Example No. | Composition | Commercial name | Maker's name | Amount based on the total solid content in coating color (%) | Degree of drop 2nd sheet | Degree of drop 3rd sheet |
|---|---|---|---|---|---|---|
| Example 11 | Styrene-butadiene latex | D-1876 | Asahi Dow | 15 | 8 | 7 |
| Example 12 | Styrene-butadiene latex | " | " | 20 | 5 | 5 |
| Example 13 | Styrene-butadiene latex | Naugatex 2752E | Sumitomo Naugatuck | 20 | 20 | 3 |
| Example 14 | Low styrene-butadiene latex | Nipol LX 119 | Nippon Geon | 5 | 25 | 3 |

TABLE 1-continued

| Example No. | Composition | Commercial name | Maker's name | Amount based on the total solid content in coating color (%) | Degree of drop 2nd sheet | Degree of drop 3rd sheet |
|---|---|---|---|---|---|---|
| Example 15 | Low styrene-butadiene latex | " | " | 20 | 3 | 1 |
| Example 16 | Low styrene-butadiene latex | " | " | 25 | 5 | 2 |
| Example 17 | Modified styrene-butadiene latex | Nipol LX 424 | " | 30 | 6 | 3 |
| Example 18 | Modified styrene-butadiene latex | " | " | 20 | 7 | 4 |
| Example 19 | Ethylene-vinyl acetate copolymer | OM-4000 | Kuraray | 20 | 37 | 5 |
| Example 20 | Vinyl acetate-acryl copolymer | Nicasol RX 201A | Nippon Carbide | 10 | 50 | 5 |
| Example 21 | Polyacrylamide | TY-007 | Showa Denko | 20 | 37 | 4 |
| Example 22 | Styrene-acrylic acid | Movinyl DM-60 | Hoechst Synthetic Chemical | 20 | 52 | 6 |
| Example 23 | Vinylidene chloride copolymer | Diofan 2076D | Yuka Badisch | 20 | 45 | 15 |
| Example 24 | Polyvinyl alcohol | PVA-105 | Kuraray | 20 | 47 | 14 |
| Example 25 | Hydroxyethyl cellulose | — | — | 20 | 48 | 5 |
| Example 26 | Oxidized starch | MS-3800 | Nippon Shokuhin Kako | 20 | 43 | 9 |
| Example 27 | Low styrene-butadiene latex | Nipol LX-119 | Nippon Geon | 10 | 17 | 9 |
| | Polyacrylamide | TY-007 | Showa Denko | 10 | | |
| Example 28 | Medium styrene-butadiene latex | Nipol LX-204 | Nippon Geon | 10 | 15 | 5 |
| | Oxidized starch | MS 3800 | Nippon Shokuhin Kako | 5 | | |
| Example 29 | Low styrene-butadiene latex | Nipol LX-119 | Nippon Geon | 15 | 21 | 10 |
| | Vinyl acetate | Nicasol CL-122 | Nippon Carbide | 5 | | |
| Example 30 | Medium styrene-butadiene latex | Nipol LX-204 | Nippon Geon | 10 | 10 | 3 |
| | Ethylene-vinyl acetate copolymer | OM-4100 | Kuraray | 10 | | |
| Example 31 | Styrene-butadiene latex | D-1876 | Asahi Dow | 10 | 20 | 4 |
| | Vinyl acetate-acryl | Nicasol RX-201A | Nippon Carbide | 10 | | |
| Example 32 | Medium ethylene-butadiene latex | Nipol LX 204 | Nippon Geon | 15 | 10 | 2 |
| | Vinyl acetate-acryl | Nicasol RX-201A | Nippon Carbide | 5 | | |
| Comparative Example 2 | Vinyl acetate resin | Polysol PS-10 | Showa Kobunshi | 20 | 57 | 11 |
| Comparative Example 3 | Ethylene-vinyl acetate copolymer | OM-4000 | Kuraray | 20 | 37 | 5 |
| Comparative Example 4 | Polyacrylamide | TY-007 | Showa Denko | 20 | 37 | 4 |
| Comparative Example 5 | Medium acrylonitrile-butadiene copolymer | Nipol 1577 | Nippon Geon | 20 | 50 | 5 |
| Comparative Example 6 | Styrene-acrylic acid | Mowinyl DM-60 | Hoechst Synthetic Chemical | 20 | 57 | 6 |
| Comparative Example 7 | Vinylidene chloride copolymer | Diofan 2076D | Yuka-Badisch | 20 | 45 | 15 |
| Comparative Example 8 | Polyvinyl alcohol | PVA-105 | Kuraray | 20 | 47 | 14 |
| Comparative Example 9 | Hydroxyethyl cellulose | — | — | 20 | 48 | 5 |
| Comparative Example 10 | Oxidized starch | MS-3800 | Nippon Shokuhin Kako | 20 | 43 | 9 |
| Comparative Example 11 | Dextrin | — | — | 20 | 57 | 13 |
| Comparative Example 12 | Vinyl acetate resin | Polysol PS-10 | Showa Kobunshi | 25 | 56 | 10 |
| Comparative Example 13 | Polyacrylamide | TY-007 | Showa Denko | 10 | 58 | 10 |
| Comparative Example 14 | " | " | " | 25 | 50 | 10 |

By comparing the examples and comparative examples presented above, it can be understood that the degree of drop is evidently different between them and the mixing of water-soluble polymer and/or latex exhibits a remarkable effect.

What is claimed is:

1. In a plain paper transfer type pressure-sensitive copying paper comprising (A) a coated paper obtained by coating on the surface of a support an aqueous coating color comprising (1) a colorless electron-donating color-forming agent , (2) a colorless electron-accepting color-developing agent capable of reacting with said color-forming agent to yield a colored product, one or both of the color-forming agent and the color-developing agent being micro-encapsulated, and (3) a wax and (B) a plain paper facing with the coated surface of the coated paper; the improvement comprising the said aqueous coating color also containing a surfactant in an amount of 3–15% by weight based on the solid content of said coating color and a styrene-butadiene copolymer as a water-soluble polymer and/or latex in an amount of 5–30% by weight based on the solid content of said coating color.

* * * * *